United States Patent [19]

Salenbo

[11] 4,437,851

[45] Mar. 20, 1984

[54] METHOD AND APPARATUS FOR HANDLING AND SETTING UP LARGE SIZE SLIT-BOXES

[76] Inventor: Sten Å. Salenbo, Berlinggatan 3, 244 00 Kävlinge, Sweden

[21] Appl. No.: 275,691

[22] Filed: Jun. 22, 1981

[30] Foreign Application Priority Data

Jun. 25, 1980 [SE] Sweden ..... 8004702

[51] Int. Cl.[3] ..... B31B 5/02

[52] U.S. Cl. ..... 493/124; 493/123; 493/141; 493/313

[58] Field of Search ..... 493/124, 123, 122, 128, 493/141, 183, 313, 314, 315, 316, 317, 125; 53/564, 566

[56] References Cited

U.S. PATENT DOCUMENTS

| | | | |
|---|---|---|---|
| 3,013,477 | 12/1961 | Meyer | 493/128 |
| 3,397,624 | 8/1968 | Currie, Jr. et al. | 493/141 |
| 4,133,254 | 1/1979 | Odom et al. | 493/125 |
| 4,160,406 | 7/1979 | Nowacki | 493/128 |
| 4,163,414 | 8/1979 | Bachman, Jr. et al. | 493/183 |
| 4,201,118 | 5/1980 | Calvert et al. | 493/141 |
| 4,348,853 | 9/1982 | Morse et al. | 53/566 |

FOREIGN PATENT DOCUMENTS

| | | | |
|---|---|---|---|
| 2023548 | 1/1980 | United Kingdom | 493/128 |

*Primary Examiner*—Nicholas P. Godici
*Assistant Examiner*—Kurt Rowan
*Attorney, Agent, or Firm*—Larson and Taylor

[57] ABSTRACT

A method and an apparatus for handling and setting up large slit-boxes of the type which is formed by a tubular slit-box blank (6) which is collapsed into a flat two layer blank and which comprises sides (7,8) with connected inner flaps (9) and outer flaps (10) respectively at at least one end of the slit-box. The slit-box is handled in a horizontal position by means of a catcher carriage (16) which is displaceable between a first position over a magazine for slit-box blanks (6) and second position for setting up the slit-box blanks. The carriage has a first set of catchers (17) to catch a first side (8) and its connected outer flaps (10) in the first layer of slit-box blanks and a second set of catchers (20) to catch the second side (7) in the upper layer of the slit-box blank. The said second side (7) is released so that the slit-box by its own weight moves to a more or less open position. The inner flap (9) of the released slit-box side (7) in then introduced into the space between the outer flaps (10). Finally the outer flaps (10) are folded in over the inner flaps (9). The folding in of the said first mentioned inner flap (9) is preferably by means of a crank arm (22) having a horizontal arm portion (24) which both provides a substantially complete straightening up of the container blank into parallelipedical tube form by folding in the inner flap (9) and a retaining of the two inner flaps (9) during a predetermined phase of the folding in of the outer flaps (10) over the inner flaps (9). The apparatus may comprise means for sealing the outer flaps (10) to the inner flaps (9).

9 Claims, 8 Drawing Figures

METHOD AND APPARATUS FOR HANDLING AND SETTING UP LARGE SIZE SLIT-BOXES

Figure 1:
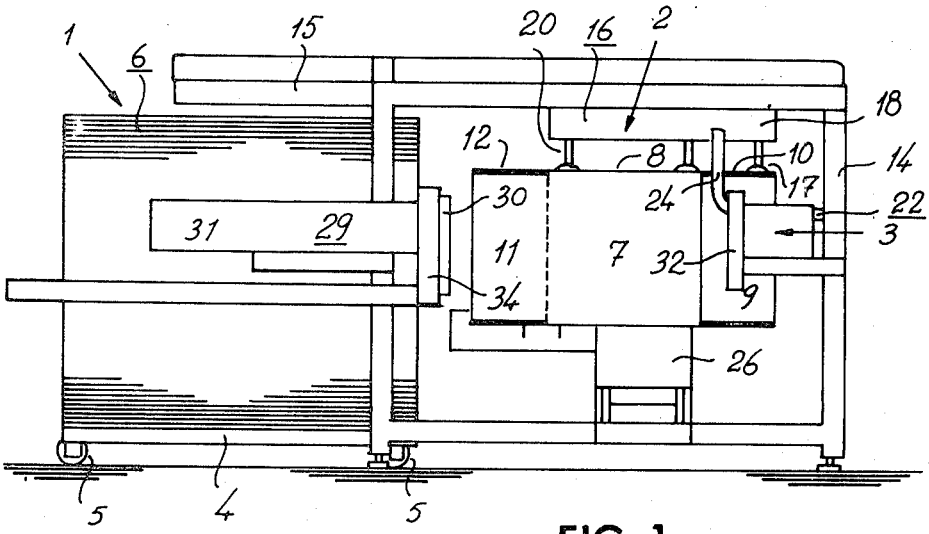

The present invention relates to a method and an apparatus for setting up large size slit-boxes. By slit-boxes is meant containers generally made of card board, corrugated card board or similar material which are formed from a flat blank and comprise sides and four close flaps at at least at one end, and in which the container is joined to a flat collapsed tube-formed blank. Generally the outer side edges of the blank are joined by a glue joint or by means of clips. Before such a slit-box is filled it must be set up by rotating the box about the corners to a parallelepipedical form, and the close flaps must be folded in or closed at one end of the box.

Methods and apparatus for such setting up and partly closing of slit-boxes are previously known, for instance from the Swedish Patent No. 361 010. In said method and apparatus the flat collapsed slit-box blanks are placed standing on edge in a magazine and are blank by blank pulled out of the magazineby a horizontally acting extracting apparatus while co-operating with erecting bars which during the pulling out of the slit-box blank from the magazine gives the box a parallelepipedical form, whereupon the slit box is closed at one end. The slit-box blanks stand on the edges of the close flaps, and the method and the apparatus gives an upright box which is closed in the bottom.

The unknown method and apparatus functions well for small and medium size slit-boxes but are not useful for very large size slit-boxes. By very large size slit-boxes is meant in this connection boxes the longest side of which is more than about 500 mm long and the height of the side likewise may be more than 500 mm and which slit-boxes often have a large length and likewise a large height of more than 1,000 mm. Such large size slit-box blanks are very difficult to handle and there are substantial problems involved in stapling the standing blanks, especially standing on the close flaps. Therefore it would be an advantage to be able to handle such slit-box blanks lying, for instance lying on a pallet, whereby in addition thereto the extra work of re-piling the container blanks is avoided.

The said very large slit-box blanks are also difficult to handle since, depending on the large size they are relatively pliant, and it may be very difficult or even impossible to handle the standing blanks standing since they may collapse.

It is also difficult to guide the very large slit-box blanks, especially by means of fixed guide bars, and also for this reason it may be difficult or even impossible to handle large slit-boxes in the said previously known apparatus.

The object of the invention therefore is to solve the problem of providing a new and safe method and apparatus for handling and setting up very large size slit-boxes. In said method and apparatus the slit-boxes which are connected by being sideglued or in any other way interconnected are received while lying by means of a catcher apparatus having a catching means and the blanks are lifted from the magazine to a setting up station in which the slit-box is opened in that some of the catcher means are disconnected so that one of the two caught sides in the upper layer of the slit-boxes is disconnected and depending on its own weight falls. Thereby the slit-box is opened at least partly, and the final setting up into parallelepipedical form is made in that one of the inner close flaps of the slit-box is folded in, whereby the close flap while sliding along the two outer close flaps brings the container into a parallelepipedical form. Thereafter the opposite inner close flap is folded in and the container is finally closed by folding in the two opposite outer close flaps.

The handling of the piled slit-box blanks preferably is made by a catcher carriage having at least five catcher devices, four of which seize one of the container sides and the bottom flap thereof at the upper layer of the slit-box blank whereas the fifth or possible further catcher devices hold the other side and possibly also the bottom flap thereof of the said upper layer of the slit-box blank. The catcher carriage may be displacable on a transverse beam along which the carriage together with the caught blank is moved to a setting up position in which the said fifth and possible further catcher devices are disconnected so that the corresponding side and the close flap are let free. For folding in the close flap of the released side any mechanical, pneumatic or correspondingly acting means is used for holding in the close flap between the two outer bottom flaps which are still maintained unfolded.

The magazine may be formed so that the pile of slit-box blanks are successively raised so that the upper slit-box blank is always on a suitable level for being caught by the catcher devices. Alternatively the catcher devices may be reciprocably movable in the vertical direction so that they can catch the uppermost slit-box blank from a successively lowered level.

The final setting up of the slit-box into parallelepipedical form is made in that the opposite inner close flap likewise is folded in between the horizontally extending outer bottom flaps, whereupon the said outer bottom flaps are folded in over the inner flaps and may be attached thereto.

Further characteristics of the invention will be evident from the following detailed specification in which reference will be made to the accompanying drawings.

In the drawings

FIG. 1 diagrammatically shows a side view of an apparatus for executing the method according to the invention.

Figure 2:
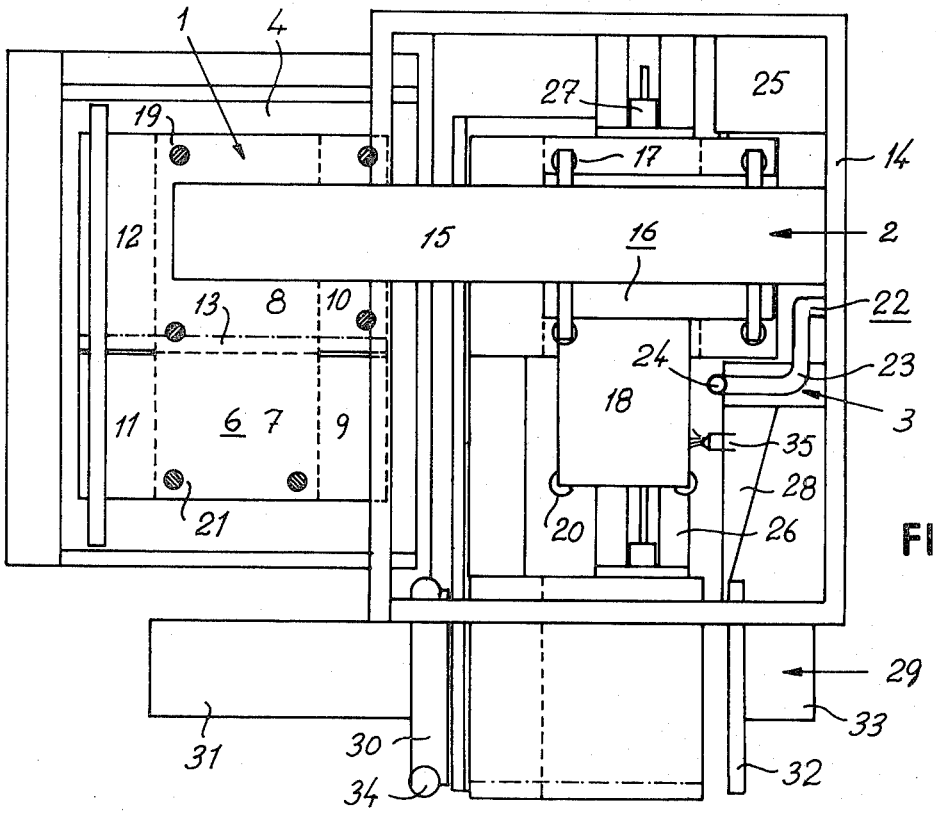
Figure 3A:
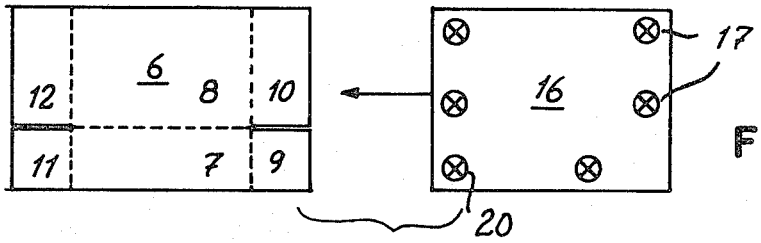
Figure 3B:
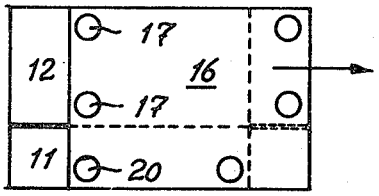
Figure 3C:
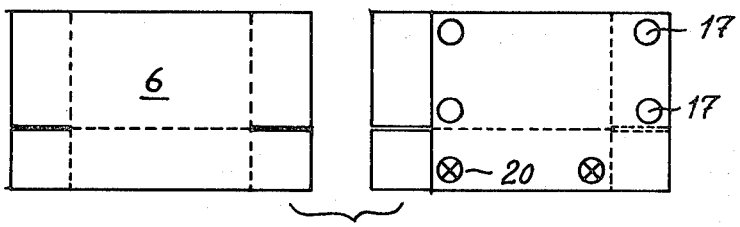
Figure 3D:
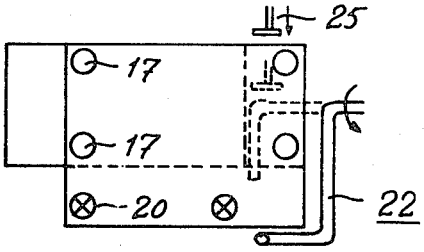
Figure 3E:
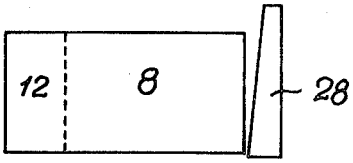
Figure 3F:
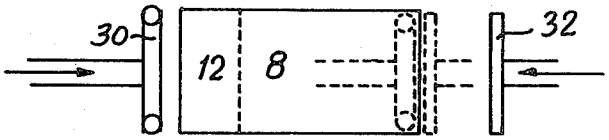

FIG. 2 shows a top view of the apparatus of FIG. 1.

FIGS. 3*a* to 3*f* shows six different steps of the operation when setting up a slit-box.

The apparatus shown in FIGS. 1 and 2 generally comprises a magazine 1 for flat collapsed slits-box blanks which are connected at one side by a glue joint or any other joint, a catcher means 2 for collecting and moving one by one a slit-box blank from the magazine to a setting up station and means 3 for straightening up and bottom closing the set up slit-box.

The magazine 1 can be stationary or movable and in the figures the magazine comprises a carriage 4 which is movable on rollers and which can be put in a predetermined position in relation to a frame supporting the catcher means 2 and the bottom closing means 3. The carriage 4 may contain means (not illustrated) for exactly locating slit-box blanks 6 on the carriage 4. The carriage may be a roller pallet on which the slit-box blanks are placed after having been pushed and sideglued, or it may be a separate carriage on which a pallet together with slit-box blanks can be placed.

The illustrated slit-box blanks are intended to provide a parallelepipedical container having short sides 7, long sides 8, inner bottom flaps 9 and outer bottom flaps 10. In the illustrated case the slit-box blank also has corresponding top flaps 11 and 12 respectively. It should be noted, however, that the method according to the invention may as well be used in connection with containers whithout such top flaps. The slit-box blanks 6 are folded together to a flat collapsed state, wherey each blank provides a lower and an upper layer each comprising two sides 7, 8 and their respective flaps 9, 10. The free ends of each slit-box blank are interconnected by a glue joint, by means of clips or in any other way at a joint 13 which is diagrammatically marked with phantom lines in FIG. 2.

The catcher means 2 and the bottom closing means 3 are mounted in a common frame 14 which also is formed as a receiver for the magazine 1.

The catcher means 2 comprises a transverse beam 15 projecting some distance out of the magazine 1 and mounted in the frame 14. In the transverse beam 15 a catcher carriage 16 having catching means such as suction catchers 17 is displacable mounted. The catchers 17 are mounted to move up and down in a folder plate 18. The catcher means preferably are adjustable for adapting the apparatus to different forms and sizes of slit-box blanks. In the illustrated case four catchers 17 are mounted in position to catch the long side 8 and the bottom flap 10 of the slit-box blank as diagrammatically indicated with the shadowed points 19 of FIG. 2. In addition to catchers 17 the catcher means must comprise at least one further catcher means such as suction catcher 20 for seizing the short side 7 adjacent the outer edge thereof as indicated with the shadowed points 21 of FIG. 2. If only one such further catcher 20 is used it should be located about at the center of the short side 7, and if two such further catchers are used as shown in the figures they ought to be located centrally in relation to side 7 as shown in FIG. 2.

The catcher means 2 comprises (means not-illustrated) for connecting the catchers 17 and 20 to sources of sub-pressure and means (also not illustrated) for controlling the movement of catcher carriage and the function of the catchers, the function of which is as follows.

When catching a slit-box blank 6 from the magazine 1 the carriage 16 together with the holder plate 18 is moved out to a position above the blank and so that the catchers 17 and 20 come into contact with the blank at the points 19 and 21 respectively. The catchers are put under vacuum, and the holder plate 18 together with the uppermost slit-box blank 6 is moved into the frame 14 to a position for setting up the blank and for starting the bottom closing thereof. This is accomplished in that the catchers 20 are disconnected, whereby the slit-box, depending on its own weight is completely or partly opened in that the short side 7 and its flaps 9 and 11 fall down. At this stage the bottom closing means 13 start their function. The bottom closing means comprises a first means for folding in the inner bottom flap 9 connected to one of the short sides 7, a second means for folding in the inner bottom flap connected to the other short side 7 and third means for folding in the outer bottom flaps 10 of the long sides 8.

The means for folding in the first inner bottom flap 9 comprises a crank arm 22 which is rotatably mounted in the frame 14. The crank arm 22 is formed with a first angle portion 23 which makes it possible to move the crank arm 22 past the upper outer flap 10 when the slit-box is moved, and a second angle portion 24, the purpose of which is to bias the inner close flap 9, thereby both (1) assuring that the box opens completely and (2) presses the said flaps 9 to a position between the bottom flap 10 of the long sides 8, whereby the box when needed is further straightend up. This function is provided in that the crank arm 22 is rotated from the illustrated upper position to a lower position in which the second angle portion 24 extends substantially horizontally. The axis of rotation of the crank arm 22 is located slightly aside of the center point of the long side 8, toward the front short side 7, and the crank arm thereby admits a free folding of the inner bottom flaps 9 of the rear short side. This is accomplished by means of a folding in means 25 which is indicated only diagrammatically and which may be a pneumatically or otherwise actuatable arm which from a position outside of the container pushes the rear flap 9 towards the interior of the container.

When the two inner bottom flaps 9 have been folded in the outer bottom flaps 10 also should be folded in, and this is accomplished in that the catchers 17 are disconnected and that the slit-box is moved onto a table 26 by means of an extendable driver 27, whereby the slit-box is moved past plowing in bars 28 or folding in arms which successively fold down the outer bottom flaps 10 to the inner bottom flaps 9. Such plowing in bars 28 are known per se in this connection and have not been shown in detail. In order to avoid that folding out of the inner bottom flaps 9 before the outer bottom flaps 10 are plowed in the crank arm 22 is maintained in its folded down position while the slit-box is moved towards the plowing in bars 28, and the horizontal angle portion 24 of the crank arm thereby slides over the two close flaps 9, maintaining same in their folded position.

At the same time as the catchers 17 are disengaged from the slit-box the catcher carriage 16 is moved out over the magazine for collecting a new slit-box blank, and when the new slit-box blank 6 has been closed this slit-box blank comes into a position for being further handled.

Such further handling may be filling the box with goods to be packed or it may be a sealing of the bottom of the slit-box. Such sealing may be made with a sealing means 29 comprising a pressure plate 30 having a pneumtic or hydraulic actuation cylinder 31 and a counter pressure plate 32 with a pneumatic or hydraulic actuation piston 33. The pressure plate 30 preferably is formed with vertically standing side rollers 34 which are adjustable in the vertical and in the horizontal direction for exactly adapting the rollers to the inner forms and side of the slit-box. When moving the pressure plate 30 into the slit-box, this box is straightend up. For sealing the bottom the apparatus may be provided with a glue mill 35 which sprays glue onto the inner bottom flaps 9 when said flaps move past the glue mills, and when pressing the inner bottom flaps 9 and the outer bottom flaps 10 together the container is thereby sealed. In order to obtain a high accuracy when sealing the container and for avoiding an unwanted change of form of the slit-box the counter pressure plate 32 can also be extended, and it is provided to be extended so as to meet the pressure plate 30 exactly when said plate reaches the bottom of the container. After the slit-box is sealed it is ready to be filled by pushing the goods to be packed sideways into the slit-box while this box is still in direction connection with the above described apparatus.

In FIG. 3 there is diagrammatically illustrated the complete function of the apparatus as illustrated in six steps marked 3*a* to 3*f*. FIG. 3*a* shows is shown how the catcher carriage 16 moves towards the pile of slit-box blanks with the suction catchers 17 and 20 disconnected. In FIG. 3*b* two of the suction catchers 17 have seized the long side 8, the other two suction catchers 17 have seized the outer bottom flap 10 and the two suction catchers 20 have seized the short side 7. FIG. 3*c* shows how the catcher carriage 16 together with a slit-box blank is lifted from the magazine and is moved over to a setting up and closing position, and for the purpose the suction catchers 20 have been disconnected, whereby three of the sides of the container fall down so that the container is partly opened. FIG. 3*d* shows diagrammatically how the crank arm 22 presses the bottom flap 9 of the short side 7 to a position between the outer bottom flaps. In this connection it may be pointed out that it is of importance that the suction catchers 17 also engage the upper bottom flap 10 since otherwise said upper bottom flap 10 might fold down depending on its own weight, thereby preventing the introduction of the inner bottom flap 9. The lower outer bottom flap 10 may be allowed to fold down slightly in order to admit a free introduction of the close flap 9. FIG. 3*e* shows how the two inner bottom flaps 9 have been folded in and the two outer bottom flaps 10 have been folded in over the inner flaps 9 by the actuation of the plowing bars 28. Finally FIG. 3*f* shows how the outer bottom flaps 10 can be sealed to the inner bottom flaps 9 by the interaction of the pressure plate 30 and the counter pressure plate 32. The sealing of the bottom flaps 10 to the inner flaps 9 may as well be made by means of clips, by welding a heat sealable layer or in any other way. It may also be observed that the container may also be filld and finally treated without sealing the bottom flaps 10 to the inner flaps 9.

It is to be understood that the above specification and the embodiment of the invention illustrated in the drawings is only an iluminating example and that all kinds of modifications may be presented within the scope of the amended claims.

I claim:

1. A method for handling and setting up large size slit-boxes of the type in which slit-box blanks are maintained in a magazine in a generally flat state, collapsed into layers, from which they are taken and formed into a container tube having sides and opposed inner bottom flaps and opposed bottom flaps integral with the sides, comprising the steps of:

taking the slit-box blanks individually from the magazine by catcher means having first catchers, wherein the first catchers engage a first side of the slit-box blank and the bottom flap connected thereto; which is the upper outer bottom flap, and at least one further catcher engages a second side of the box, adjacent to and generally parallel to the first side, moving the slit-box blank, engaged by the catchers, to a setting up position, disengaging the further catcher to release the second side, thereby releasing the second side and the bottom flap connected thereto to fall downwardly, whereby the blank opens up as the second side becomes vertical while the first side is still held horizonally by the first catchers, folding in the inner bottom flap connected to the released second side between the opposed outer bottom flaps and then folding in the other inner bottom flap, and folding in the outer bottom flaps over the folded in inner bottom flaps.

2. A method according to claim 1, wherein the first catchers include at least two catcher devices which engage the said first side adjacent the intended upper end of the container and at least two other catcher devices which engage the outer bottom flap connected to the said first side, and wherein the second catcher includes at least one catching device which engages the said second side so as to support that side symmetrically about a center line therethrough parallel to the upper end lower boundries of said side.

3. A method according to claim 1, wherein, after the second side is released, including the step of straightening up said second side to substantially a right angle with the said first side, and wherein a crank arm having a horizontal branch forces inwardly the bottom flap connected to said second side, and wherein a folding mechanism folds in the other inner bottom flap before the folding in of the outer bottom flaps.

4. A method according to claim 3, wherein the step of folding in the outer bottom flaps is carried out while the slit-box is moved along a feed table and by the actuation of plowing bars, and wherein movement of the crank arm, upon its movement to fold in the first said inner bottom flap retains first one and then thereafter both inner bottom flaps in their folded in position until the outer bottom flaps are folded in by a predetermined amount.

5. A method according to any one of claims 1–4, wherein the step of final forming the slit-box to the intended form and securing of the outer bottom flaps to the inner bottom flaps is carried out by operating a pressure plate by actuating a pressure piston to push the pressure plate into the interior of the slit-box and into engagement with the inside of the inner bottom flaps and operating a counter pressure plate to push the same against the outside of the outer bottom flaps, and securing the inner and outer bottom flaps together concurrent with exerting pressure on the bottom flaps with the said pressure plate and counter pressure plate.

6. An apparatus for handling and setting up large slit-boxes of the type in which the slit-box is formed by a generally tubular slit-box blank having sides, two of which sides have opposed bottom inner flaps connected thereto and two other sides of which have opposed outer bottom flaps connected thereto, comprising; a magazine for receiving a pile of generally flat slit-box blanks, a catcher means displacable between a first position above the magazine and a second position to the side thereof for setting up the slit-box by successively engaging the uppermost slit-box blank in the magazine and moving the same to a setting up position, said catcher means including a catcher carriage which is displaceable between a position above the magazine and setting up position, said catcher carriage including a first set of catcher devices intended to engage one of the sides of the slit-box blank which faces upwardly and also engage the bottom flap connected to the first said side, which bottom flap is an outer bottom flap, further catcher devices positioned to engage another side of the slit-box blank adjacent to the first said side, which second side also faces upwardly when the slit-box blank is positioned in the magazine, means for moving the catcher carriage between said two positions, means for actuating the catcher devices and means for controlling operation of the catcher devices so that the second catcher devices associated with the second side of the slit-box container disengage that side before the first set of catcher devices disengage the first said side, means for folding in the two inner bottom flaps into the space between the two opposed outer bottom flaps and means for folding in the outer bottom flaps over the folded in inner bottom flaps.

7. An apparatus according to claim 6, wherein said means for actuating the catcher devices and the means for controlling the operation of the catcher devices are operable to release the said second side while the first side is still being held by the first catcher devices, whereby the second side falls downwardly to a vertical position, generally perpendicular to the first said side which is still being held by the first catcher devices, a crank arm for pressing inwardly the inner bottom flap connected to the released, second side, into the space between the adjacent, opposed outer bottom flaps, means for introducing the opposite inner bottom flap into the said space between the opposed outer bottom flaps and means for folding in the outer bottom flaps over the folded in inner bottom flaps.

8. An apparatus according to claim 7, wherein the means for folding in the opposed outer bottom flaps include plowing bars operable while moving the slit-box along a feeder table, and wherein said crank arm includes a horizontal arm portion which, during the movement of the slit-box retains first one and thereafter both of the inner bottom flaps in their folded in position until the outer bottom flaps have been folded in by a predetermined amount.

9. An apparatus according to any one of claims 6–8, including means for final setting up and bottom sealing of the slit-box, said means comprising a pressure plate actuated by a pressure piston and being of substantially the same form and size as the interior of the slit-box and which is mounted to be introduced into the top of the slit-box and against the inside of the inner bottom flaps, and including a counter pressure plate which is mounted to be moved against the outer side of the folded in outer bottom flaps to oppose the said pressure plate, whereby the inner bottom flaps and the outer bottom flaps may be joined together as pressure is exerted thereon by the said pressure plate and the said counter pressure plate.

* * * * *